US009518306B2

(12) United States Patent
Maekawa et al.

(10) Patent No.: US 9,518,306 B2
(45) Date of Patent: Dec. 13, 2016

(54) TOP-FIRING HOT BLAST STOVE

(75) Inventors: Norimasa Maekawa, Fukuoka (JP); Koya Inoue, Fukuoka (JP); Hiroshi Shimazu, Fukuoka (JP); Shunji Koya, Fukuoka (JP); Naoki Kunishige, Fukuoka (JP); Nobuhiro Ohshita, Fukuoka (JP)

(73) Assignee: Nippon Steel & Sumikin Engineering Co., Ltd, Tokyo (JP)

( * ) Notice: Subject to any disclaimer, the term of this patent is extended or adjusted under 35 U.S.C. 154(b) by 0 days.

(21) Appl. No.: 14/005,019

(22) PCT Filed: Mar. 13, 2012

(86) PCT No.: PCT/JP2012/056339

§ 371 (c)(1),
(2), (4) Date: Sep. 13, 2013

(87) PCT Pub. No.: WO2012/124667

PCT Pub. Date: Sep. 20, 2012

(65) Prior Publication Data

US 2014/0004475 A1 Jan. 2, 2014

(30) Foreign Application Priority Data

Mar. 15, 2011 (JP) ..... 2011-056238
Jul. 20, 2011 (JP) ..... 2011-159258

(51) Int. Cl.
*C21B 9/14* (2006.01)
*C21B 9/10* (2006.01)
*F23D 14/22* (2006.01)

(52) U.S. Cl.
CPC . *C21B 9/14* (2013.01); *C21B 9/10* (2013.01); *F23D 14/22* (2013.01);
(Continued)

(58) Field of Classification Search
CPC ... F23C 2900/07002; F23C 7/008; F23C 5/06; F23D 14/48; F23D 14/46; F23D 14/00; F23D 14/84; F23D 2203/00; F23D 2900/21001; F23D 14/20; F23D 14/22; F23D 14/24; F23D 11/10; F23D 11/108; F23D 14/16; F23L 1/00
(Continued)

(56) References Cited

U.S. PATENT DOCUMENTS 3,852,022 A * 12/1974 Medeot ..... F23D 11/40 239/420
3,905,751 A * 9/1975 Hemsath et al. ..... 431/183
(Continued)

FOREIGN PATENT DOCUMENTS

CN 85100733 A 8/1986
CN 101381786 3/2009
(Continued)

OTHER PUBLICATIONS

International Search Report of PCT/JP2012/057051, mailed Jun. 19, 2012.
(Continued)

*Primary Examiner* — Steven B McAllister
*Assistant Examiner* — Ko-Wei Lin
(74) *Attorney, Agent, or Firm* — McCarter & English, LLP

(57) ABSTRACT

There is provided a top-firing hot blast stove including a burner and a burner duct capable of stabilizing an ignition point at a desired position inside the burner duct and suppressing occurrence of blinking phenomenon so as to achieve high combustion efficiency.
A top-firing hot blast stove 10 includes a checker chamber 4 and a combustion chamber 3 which includes a burner system and placed above the checker chamber 4. The burner
(Continued)

system includes: a burner 1 provided with a fuel gas pipe 1*c* and combustion air pipes 1*b*, 1*d*; and a burner duct 2 communicating with a burner exit 1*a* of the burner 1, the burner duct 2 communicating with the combustion chamber 3 through a burner duct outlet 2*b*, wherein an aperture enlarged portion 2*c* where an aperture D1 of the burner duct 2 is enlarged is provided over a section from a middle of the burner duct 2 to the burner duct outlet 2*b*, so that an eddy current ED of the mixed gas MG flowing toward the combustion chamber 3 through the burner duct 2 is formed in the aperture enlarged portion 2*c*.

19 Claims, 6 Drawing Sheets

(52) U.S. Cl.
CPC ..... *F23D 2209/20* (2013.01); *F23D 2900/14241* (2013.01); *F23D 2900/21001* (2013.01)

(58) Field of Classification Search
USPC ..... 432/217, 159–190, 350–353; 431/185, 431/187–189, 159, 162, 170
See application file for complete search history.

(56) References Cited

U.S. PATENT DOCUMENTS

| | | | | |
|---|---|---|---|---|
| 4,054,409 | A | 10/1977 | Ando et al. | |
| 4,657,504 | A * | 4/1987 | Akiyama et al. | 431/166 |
| 4,881,895 | A | 11/1989 | Felthuis et al. | |
| 5,052,922 | A | 10/1991 | Stokman et al. | |
| 5,433,599 | A | 7/1995 | Van Laar et al. | |
| 5,667,376 | A * | 9/1997 | Robertson et al. | 431/115 |
| 7,654,819 | B2 | 2/2010 | Okada et al. | |
| 2004/0166451 | A1* | 8/2004 | Watanabe | 431/4 |
| 2007/0254251 | A1* | 11/2007 | Cao et al. | 431/10 |
| 2010/0279239 | A1* | 11/2010 | Takashima et al. | 431/185 |
| 2011/0076628 | A1 | 3/2011 | Miura et al. | |

FOREIGN PATENT DOCUMENTS

| | | | | |
|---|---|---|---|---|
| EP | 0491079 | | 6/1992 | |
| JP | 41-1272 | B1 | 2/1966 | |
| JP | 41-4681 | B1 | 3/1966 | |
| JP | 48-4284 | B | 2/1973 | |
| JP | 50-123006 | A | 9/1975 | |
| JP | 52-89502 | A | 7/1977 | |
| JP | S6056152 | | 4/1985 | |
| JP | 62206313 | A * | 9/1987 | |
| JP | 5-61604 | U | 8/1993 | |
| JP | 09-021509 | | 1/1997 | |
| JP | 09021509 | A * | 1/1997 | F23D 14/24 |
| JP | 2005060834 | A | 3/2005 | |
| JP | 3793466 | B2 | 7/2006 | |

OTHER PUBLICATIONS

Translation of First Office Action of Chinese Patent Application No. 201280012294.9, issued date of May 6, 2014.
Translation of First Office Action of Chinese Patent Application No. 201280012288.3, issued date of Jun. 23, 2014.
Supplementary European Search Report dated Jul. 28, 2014 relating to European Patent Application No. EP12757821.

* cited by examiner

TOP-FIRING HOT BLAST STOVE

RELATED APPLICATIONS

This application is a national stage application filed pursuant to 35 U.S.C. §371 of PCT/JP2012/056339, filed Mar. 13, 2012, which claims the benefit of Japanese Patent Application No. 2011-056238, filed Mar. 15, 2011, and Japanese Patent Application No. 2011-159258, filed Jul. 20, 2011, both of which are incorporated herein by reference in their entireties.

TECHNICAL FIELD

The present invention relates to a top-firing hot blast stove having a characteristic burner system.

BACKGROUND ART

Regenerative hot blast stoves, which generate hot blast by circulating air to a checker chamber having heat stored therein and supply the hot blast to a blast furnace, include an internal-combustion hot blast stove having both a combustion chamber and a checker chamber provided in a cylinder shell and an external-combustion hot blast stove having a combustion chamber and a checker chamber provided in separate cylinder shells so that both the chambers communicate with each other at one ends of both the shells. As a regenerative hot blast stove which can be made at a lower equipment cost than the external-combustion hot blast stove while retaining the performance comparable with the external-combustion hot blast stove, a top-firing hot blast stove having a combustion chamber, which is connected to a burner, provided above a checker chamber is disclosed in Patent Literature 1.

Now, referring to a schematic view of FIG. 7, the structure of a conventional top-firing hot blast stove will be outlined. As shown in the drawing, a conventional top-firing hot blast stove F has a combustion chamber N placed above a checker chamber T. In so-called combustion operation, mixed gas including fuel gas and combustion air supplied from a burner B to the combustion chamber N (X1 direction) ignites and combusts in the process of passing through a burner duct BD, and flows into the combustion chamber N as high-temperature combustion gas. A plurality of the burner ducts BD are provided for the combustion chamber N when two-dimensionally viewed. High-temperature combustion gas flows downward while swirling inside the combustion chamber with a large turning radius. While the combustion gas flows downward in the checker chamber T (X2 direction), the heat of the gas is stored in the checker chamber T, and the combustion gas which has passed through the checker chamber T is exhausted through a gas duct E. Note that the burner B and the burner duct BD are collectively referred to as a burner system in this specification.

In so-called air blasting operation for supplying hot blast to an unshown blast furnace, a shutoff valve V inside the burner duct BD is controlled to be closed so that air of about 150° C. for example is supplied to the checker chamber T through a blast pipe S. In the process of going upward inside the checker chamber T, the air turns into hot blast of about 1200° C. for example, and this hot blast is supplied to the blast furnace through a hot-blast pipe H (X3 direction).

Enhancement in combustion efficiency of the burners mounted on the top-firing hot blast stove is one of the important objects in the technical field concerned. In order to achieve the enhancement in combustion efficiency, it is known that not only preparing mixed gas including sufficiently mixed fuel gas and combustion air but also stabilizing an ignition point are quite important. It is also known that without a stabilized ignition point, the ignition point is fluctuated inside the burner duct or the combustion chamber, which thereby causes oscillating combustion.

In order to stabilize the ignition point, Patent Literature 2 discloses a gas burner for a hot blast stove having a ring-shaped projection provided between a burner and a burner port (burner duct) for stabilizing an ignition position by using an area around the projection as an ignition point. The structure of this hot blast stove gas burner is simulated in FIG. 8.

As shown in the drawing, fuel gas and combustion air supplied through a burner B are mixed inside the burner B or the burner duct BD to generate mixed gas. A ring-shaped projection R is provided at a middle position inside the burner duct BD, and an aperture of the burner duct BD is narrowed by this projection R. Consequently, the burner duct BD has an upstream space BD1 and a downstream space BD2 on a combustion chamber N side, separated by the projection R in a gas flow direction.

Since the ring-shaped projection R is thus provided inside the burner duct BD to narrow the aperture, an area around the projection R tends to serve as an ignition point, and therefore a so-called flame-holding portion is formed in this area. Furthermore, the projection R generates gas turbulence, which further promotes mixing between fuel gas and combustion air.

When the projection R as shown in the drawing is provided at a middle position in the burner duct BD to form a flame-holding portion, the projection R for narrowing the aperture is to be present on the downstream side of the upstream space BD1. Accordingly, if fire is ignited inside the upstream space BD1, gas inside the upstream space BD1 is heated and the volume thereof is rapidly expanded. Due to this rapid gas volume expansion, pressure inside the upstream space BD1 increases, which hinders supply of fuel gas and combustion air from the burner B, and leads to a problem of extinguishing.

When gas supply is hindered and thereby extinguishing occurs, the pressure inside the upstream space BD1 declines. As a result, the hindered supply of the fuel gas and the combustion air is resumed, and fire is ignited again.

Thus, providing the projection R at a middle position inside the burner duct BD causes a so-called "blinking phenomenon" involving repeated ignition and extinguishing, which poses a new problem to be solved.

CITATION LIST

Patent Literature

Patent Literature 1: JP Patent Publication (Kokoku) No. 48-4284 B (1973)

Patent Literature 2: JP Patent Publication (Kokai) No. 52-89502 A (1977)

SUMMARY OF THE INVENTION

Technical Problem

The present invention has been made in view of the foregoing problems, and an object of the present invention is to provide a top-firing hot blast stove including a burner system capable of stabilizing an ignition point at a desired position inside the burner duct and suppressing occurrence of blinking phenomenon so as to achieve high combustion efficiency.

Solution to Problem

In order to accomplish the above object, a top-firing hot blast stove according to the present invention includes: a checker chamber including a blast pipe for receiving supply of hot blast air; and a combustion chamber which includes a hot-blast pipe and a burner system for supplying hot blast to a blast furnace and which is placed above the checker chamber, wherein the checker chamber is heated by combustion of mixed gas including fuel gas and combustion air supplied from the burner system to the combustion chamber, and hot blast which is generated while the hot blast air passes through the checker chamber is supplied to the blast furnace through the hot-blast pipe, wherein the burner system includes: a burner provided with a fuel gas pipe and a combustion air pipe; and a burner duct communicating with a burner exit of the burner, the burner duct communicating with the combustion chamber through a burner duct outlet, wherein an aperture enlarged portion where an aperture of the burner duct is enlarged is provided over a section from a middle of the burner duct to the burner duct outlet, so that an eddy current of the mixed gas flowing toward the combustion chamber through the burner duct is formed in the aperture enlarged portion.

In the top-firing hot blast stove of the present invention, modification is applied to the burner duct constituting the burner system of the top-firing hot blast stove. In addition, the top-firing hot blast stove has a characteristic aperture enlarged portion where the aperture of the burner duct is enlarged over a section from the middle of the burner duct to the burner duct outlet which communicates with the combustion chamber. When the mixed gas including fuel gas and combustion air flows through the aperture enlarged portion, an eddy current is generated therein. As the eddy current sucks in high temperature atmosphere inside the adjacent combustion chamber, the aperture enlarged portion is maintained at high temperature, so that the aperture enlarged portion is made to function as a flame-holding portion, where a stabilized ignition point can be formed. It is to be noted that the eddy current generated in the aperture enlarged portion includes not only an eddy current of mixed gas but also an eddy current of combustion gas generated by the mixed gas ignited in the aperture enlarged portion.

Since the aperture enlarged portion faces the combustion chamber, a region with a narrowed aperture is not present on the downstream side in the gas flow unlike the case of the conventional technology, and therefore the blinking phenomenon involving repeated extinguishing and ignition would not occur.

Further, since the aperture enlarged portion serves as the flame-holding portion as described above, the aperture enlarged portion can be controlled as a stable ignition point.

Since this burner duct structure is implemented by structure modification as very simple as expanding only a part of the aperture, it does not involve increase in a manufacturing cost.

Note that the fuel gas and the combustion air supplied from the burner may be made into mixed gas inside the burner (so-called premix type), or may be made into mixed gas after flowing into the burner duct (so-called nozzle mix). For example, in the configuration where the burner has a concentric, three hole-type multiple pipe line structure, and fuel gas and combustion air circulate through respective pipe lines, the respective pipe lines may be inclined toward the burner duct and gases therein may be mixed after flowing into the burner duct, or the respective pipe lines may have a swirling blade provided therein and spiral gas flows formed inside the pipe lines may be made into mixed gas inside the burner or the burner duct.

Moreover, in the burner duct, an aperture narrowed portion where the aperture of the burner duct is reduced may be provided in the vicinity of the burner exit, and mixed gas including fuel gas and combustion air may be formed in this aperture narrowed portion.

In this embodiment, the burner duct has the aperture narrowed portion provided in the vicinity of the burner exit, i.e., at a position distant from the combustion chamber in the burner duct, so as to achieve further promotion of mixing between the fuel gas and the combustion air.

Embodiments of the aperture narrowed portion include a ring-shaped projection as seen in the conventional technology. From the viewpoint of enhancing gas mixing ability, an applicable ring-shaped projection or the like may be configured to have an inner hollow diameter gradually reduced from the burner side toward the combustion chamber side.

The phrase "the vicinity of the burner exit" is herein used to refer to a burner exit position and an arbitrary position closer to the burner side than the shutoff valve provided in the middle of the burner duct, and to exclude the positions closer to the combustion chamber as in the conventional technology. When the aperture narrowed portion is provided in the vicinity of the burner exit, fire would not ignite on the upstream side of the aperture narrowed portion, and therefore the blinking phenomenon would not occur.

According to the burner duct of this embodiment, mixing between fuel gas and combustion air is further promoted in the aperture narrowed portion. As a result, sufficiently-mixed mixed gas is introduced into the aperture enlarged portion serving as a flame-holding portion, where the gas is ignited and combusted.

In a preferable embodiment, the length of the aperture enlarged portion to the burner duct outlet is in a range of 0.3D to 1.4D where D represents a diameter of the burner duct.

Inventors of the present invention conducted an experiment to compare the combustion efficiency in a burner system of conventional structure and in the burner system constituting the top-firing hot blast stove of the present invention.

More specifically, the level of combustion efficiency is specified with the amount of unburnt CO gas. The amount of unburnt CO gas in each experiment model is measured by using, as a parameter, the length of the aperture enlarged portion which is a characteristic structure of the burner duct constituting the hot blast stove of the present invention, i.e., the length of the aperture enlarged portion to the burner duct outlet.

As a result of the experiment, it is demonstrated that the amount (proportion) of unburnt CO decreased the most when the length of the aperture enlarged portion to the burner duct outlet was in a range of 0.3D to 1.4D where D represents a diameter of the burner duct.

The above experimental result is for specifying a length range of the aperture enlarged portion which provides an optimum value of the combustion efficiency. The inventors of the present invention consider that the length of the aperture enlarged portion specified in this experiment is an optimum length from viewpoints that with the length of the aperture enlarged portion being longer than 1.4D, flame holding performance in the aperture enlarged portion may be deteriorated, resulting in deterioration in stability of the ignition position, and that with the length of the aperture enlarged portion being shorter than 0.3D, the combustion gas which swirls with a large turning radius inside the combustion chamber may reach the inside of the aperture enlarged portion as a cross wind, which thereby causes extinguishing.

Advantageous Effects of Invention

According to the top-firing hot blast stove of the present invention as is clear from the above description, the burner duct constituting a burner system which is a component member of the top-firing hot blast stove has an aperture enlarged portion with an enlarged aperture provided over a section from the middle of the burner duct to the burner duct outlet which communicates with the combustion chamber. Accordingly, when mixed gas including fuel gas and combustion air flows through the aperture enlarged portion, an eddy current is generated therein. As the eddy current sucks in high temperature atmosphere inside the adjacent combustion chamber, the aperture enlarged portion is maintained at high temperature, which makes it possible to stabilize an ignition point with the aperture enlarged portion as a flame-holding portion and to suppress the blinking phenomenon so that the combustion efficiency can be enhanced.

DESCRIPTION OF EMBODIMENTS

Hereinafter, a description will be given of embodiments of a top-firing hot blast stove of the present invention with reference to the drawings.

Figure 1:
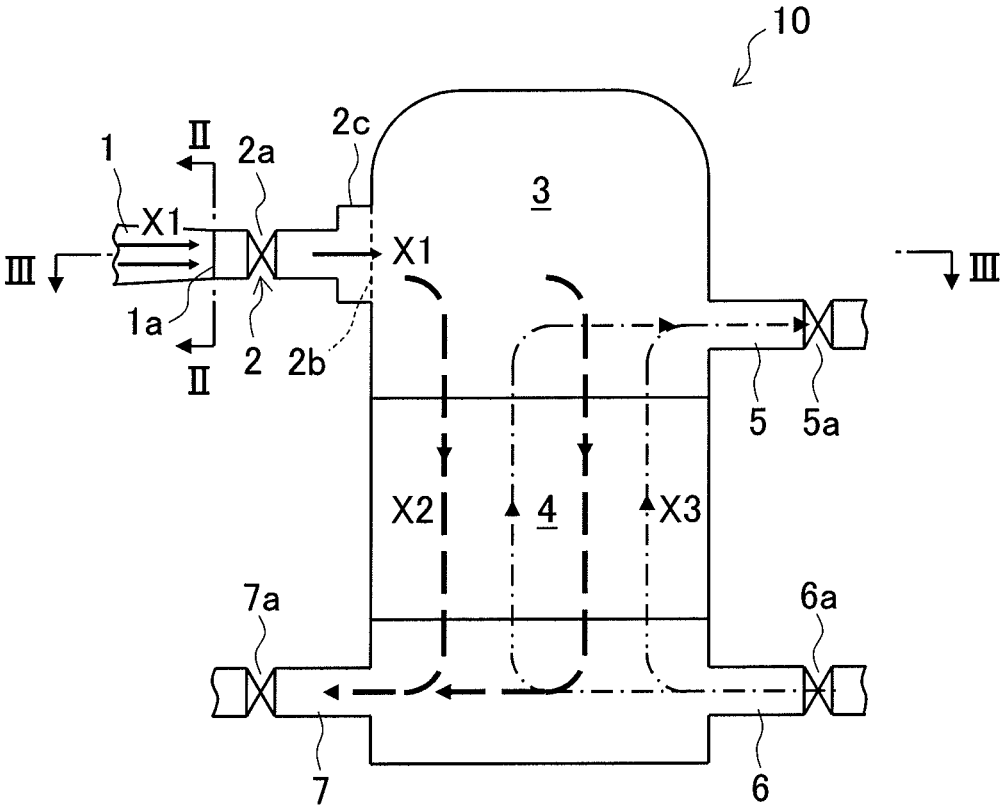
FIG. 1 is a schematic view showing one embodiment of a top-firing hot blast stove of the present invention, in which flows of mixed gas, combustion gas, hot blast air, and hot blast are shown together.
Figure 2:
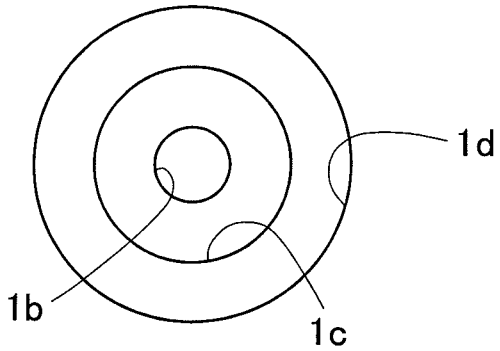
FIG. 2 is a cross sectional view taken along arrow line II-II of FIG. 1.
Figure 3:
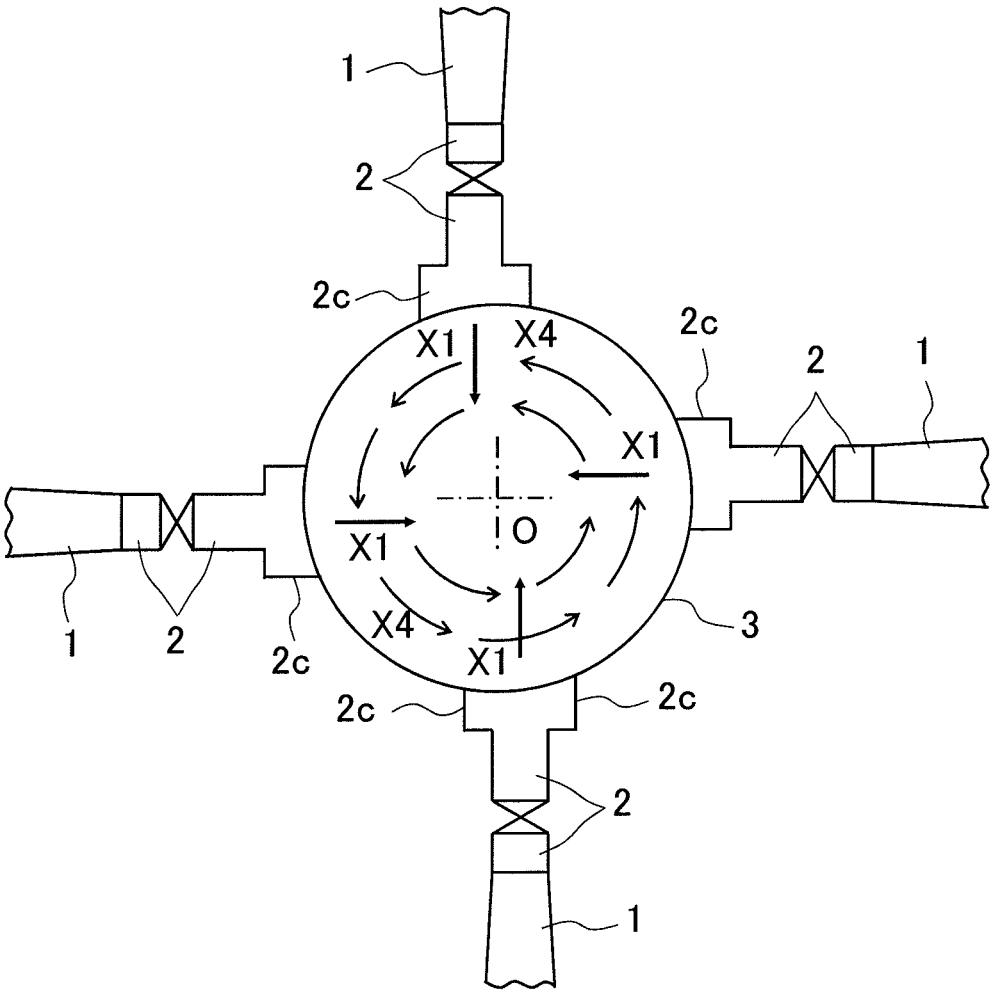
FIG. 3 is a cross sectional view taken along arrow line III-III of FIG. 1, showing flows of combustion gas in the combustion chamber.
Figure 4:
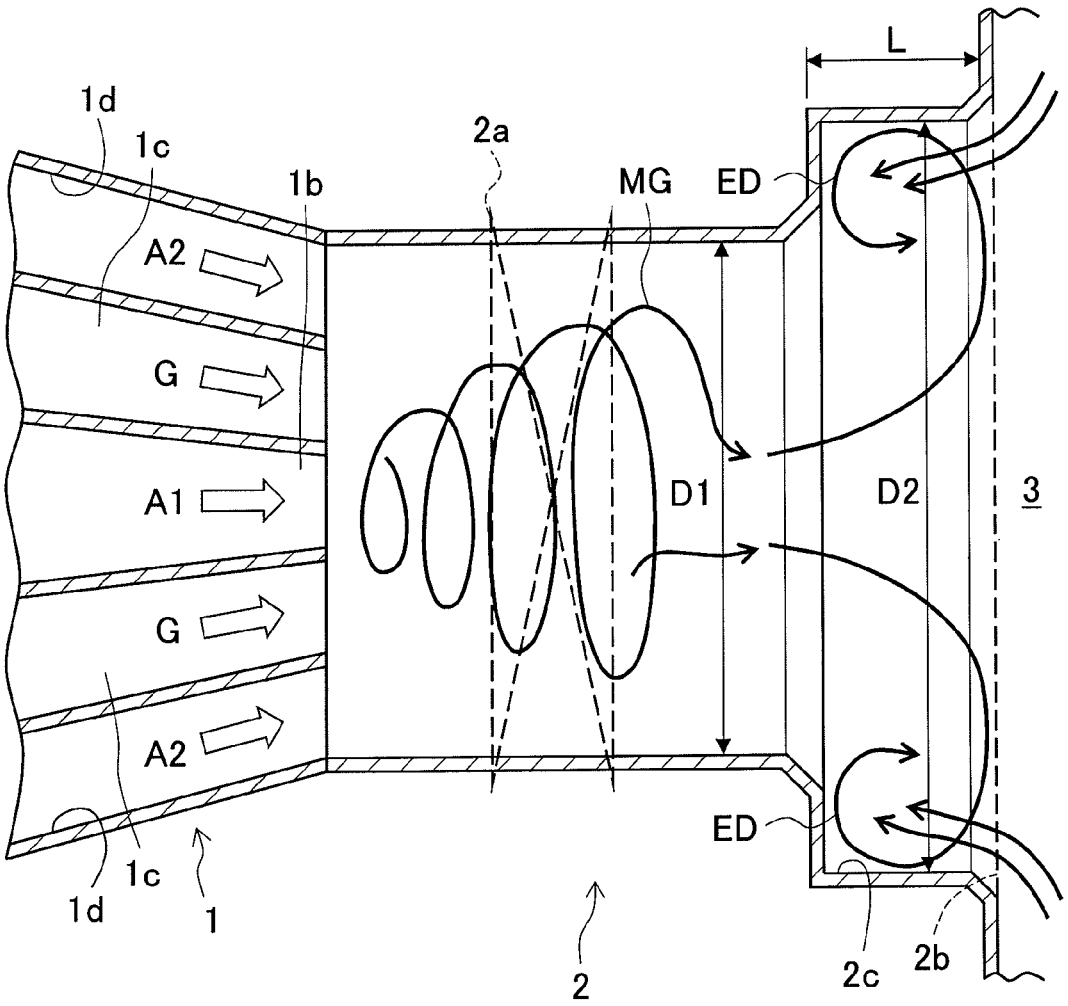
FIG. 4 is a longitudinal sectional view showing one embodiment of a burner duct.

FIG. 1 is a schematic view showing one embodiment of a top-firing hot blast stove of the present invention, in which flows of mixed gas, combustion gas, hot blast air, and hot blast are shown together. FIG. 2 is a cross sectional view taken along arrow line II-II of FIG. 1. FIG. 3 is a cross sectional view taken along arrow line III-III of FIG. 1, showing flows of combustion gas in the combustion chamber. FIG. 4 is a longitudinal sectional view showing one embodiment of a burner duct.

In a top-firing hot blast stove 10 shown in FIG. 1, a combustion chamber 3 is placed above a checker chamber 4. Mixed gas including fuel gas and combustion air supplied from a burner 1 (X1 direction) ignites and combusts in the process of passing through a burner duct 2, and flows into the combustion chamber 3 as high-temperature combustion gas. It is to be noted that the burner 1 and the burner duct 2 constitutes a burner system.

As shown in FIG. 3, four burner ducts 2 are provided on the combustion chamber 3 as viewed two-dimensionally. Each of the burner ducts 2 is connected to the combustion chamber 3 at an eccentric position so that an inflow direction of the combustion gas to the combustion chamber 3 does not pass through center O of the combustion chamber 3 which is in a circular form when two-dimensionally viewed. As a result, the combustion gas which has flowed into the combustion chamber 3 from each one of the burner ducts 2 interferes with the combustion gas which has flowed into the combustion chamber 3 from its adjacent burner duct 2. Thus, the flow direction of each combustion gas is changed so as to form a large swirling flow X4 of combustion gas in the combustion chamber 3 as shown in the drawing.

The combustion gas flows downward the checker chamber 4 while swirling as viewed two-dimensionally as shown in FIG. 3 and forming a spiral flow descending in X2 direction of FIG. 1 as viewed in longitudinal cross section. In the process of flowing downward, heat is stored in the checker chamber 4, and the combustion gas which has passed through the checker chamber 4 is exhausted through a gas duct pipe 7 in which a shutoff valve 7*a* is controlled to be opened. In the top-firing hot blast stove of conventional structure, the aforementioned two-dimensional swirling of combustion gas is promoted for the purpose of accelerating combustion. In the top-firing hot blast stove 10 shown in the drawing, two-dimensional swirling of the combustion gas is formed mainly for supplying the combustion gas to the checker chamber 4 as uniformly as possible, and therefore the combustion chamber 3 can be downsized as compared with the combustion chamber in the hot blast stove of conventional structure.

As shown in FIG. 2, the burner 1 has a concentric, three hole-type multiple pipe line structure. As shown in FIG. 4, an inner pipe 1*b* has combustion air A1 flowing therein, a central pipe 1*c* has fuel gas G flowing therein, and an outer pipe 1*d* has additional combustion air A2 flowing therein. Since the respective pipe lines are reduced in diameter (inclined) toward the burner duct 2, the gases in the respective pipe lines are mixed with each other when they flow into the burner duct 2, so that mixed gas is generated. It is to be noted that the order of the fuel gas and the combustion air which flow through the respective pipe lines may be reversed, or a swirling blade may be provided in each pipe line to generate a spiral flow while gas flows through each pipe line, so that these spiral flows may be mixed inside the burner duct.

Referring again to FIG. 1, when hot blast is supplied to an unshown blast furnace, a shutoff valve 2*a* in the burner duct 2 and a gas duct valve 7*a* in the gas duct pipe 7 are controlled to be closed, and through a blast pipe 6 with a shutoff valve 6*a* controlled to be opened, high temperature air of about 150° C. for example is supplied to the checker chamber 4. In the process of going upward in the checker chamber 4, the high temperature air turns into hot blast of about 1200° C. for example, and this hot blast is supplied to the blast furnace (X3 direction) through a hot-blast pipe 5 with a shutoff valve 5*a* controlled to be opened.

As shown in FIG. 4, the burner duct 2 is provided with an aperture enlarged portion 2*c* (aperture D2) where an aperture D1 of the burner duct 2 is enlarged over a section from the middle thereof to a burner duct outlet 2*b*. An eddy current ED is generated while mixed gas MG, which flows through the burner duct 2 toward the combustion chamber 3, passes through the aperture enlarged portion 2*c*. As the eddy current ED sucks in high temperature atmosphere inside the adjacent combustion chamber 3 (see an arrow going from the combustion chamber 3 to the aperture enlarged portion 2*c* in FIG. 4), the aperture enlarged portion 2*c* is maintained at high temperature. As a result, the aperture enlarged portion 2*c* serves as a flame-holding portion, where a stabilized ignition point position is formed. It is to be noted that the eddy current ED formed therein contains not only a mixed gas component but also a combustion gas component generated upon ignition of the mixed gas MG in the aperture enlarged portion 2*c*. As shown in FIG. 4, corners of a portion of the burner duct 2 that changes to the aperture enlarged portion 2*c* are beveled (tapered). This makes it possible to facilitate generation of the eddy current ED, and also to considerably reduce fall of a refractory material and the like in this region as compared with the case where beveling is not performed.

The aperture enlarged portion 2*c* generates the eddy current ED of the mixed gas MG, sucks in high temperature atmosphere from the combustion chamber 3, and forms a flame-holding portion to thereby stabilize the ignition point. In addition, the aperture enlarged portion 2*c* does not throttle the gas flow at the downstream side, and therefore the blinking phenomenon involving repeated ignition and extinguishing does not occur.

Thus, the illustrated burner duct 2 is implemented by structure modification as very simple as providing the aperture enlarged portion 2*c* in certain area on the combustion chamber 3 side. This makes it possible to provide the burner duct capable of ensuring ignition stability inside the burner duct 2 and suppressing the blinking phenomenon so as to achieve excellent combustibility without increase in a manufacturing cost.

Figure 5:
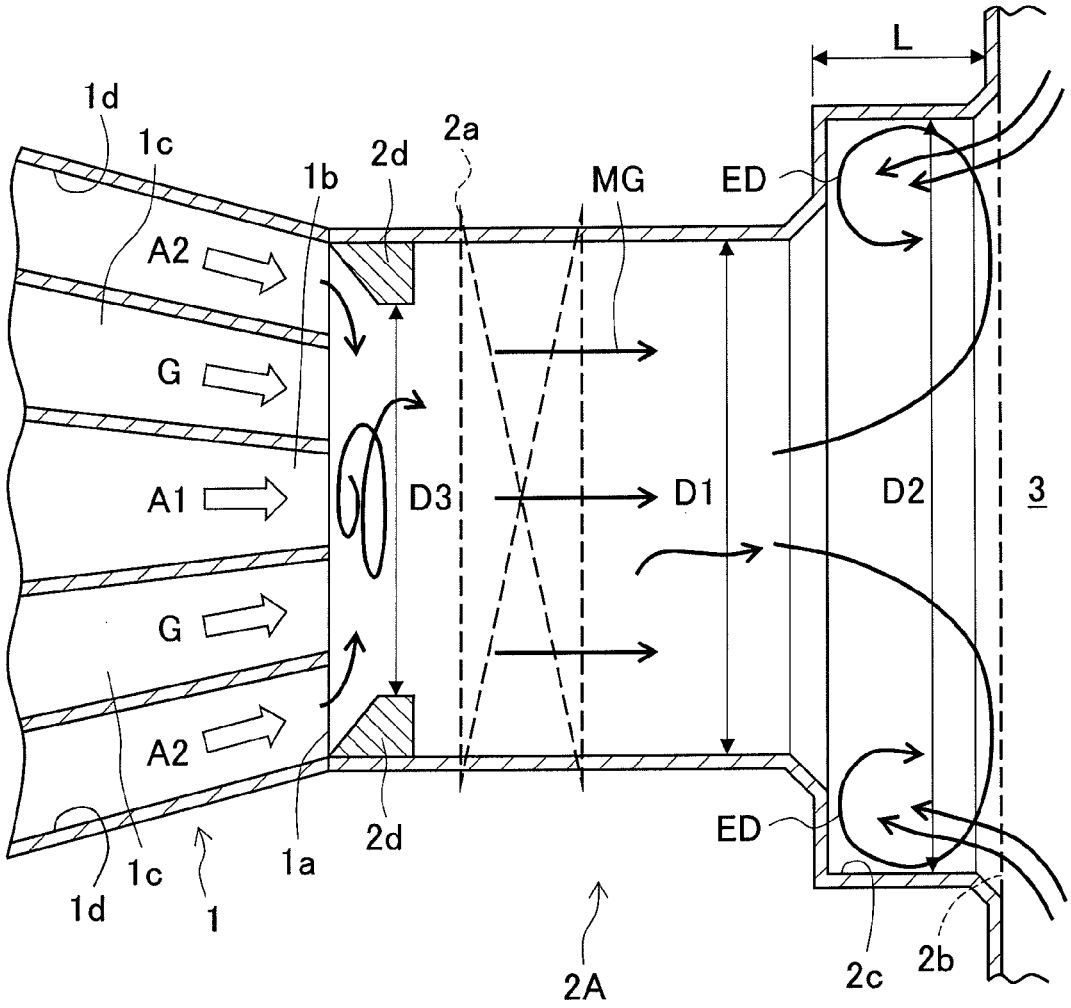
FIG. 5 is a longitudinal sectional view showing another embodiment of the burner duct.

A burner duct 2A shown in FIG. 5 is structured such that a ring-shaped aperture narrowed portion 2*d* where the aperture of the burner duct 2A is reduced is provided in the vicinity of a burner exit 1*a*. In the drawing, reference numeral D3 represents an inner diameter of the aperture narrowed portion 2*d*.

Fuel gas G and combustion air A1, A2 flowing through the pipe lines 1*b*, 1*c*, and 1*d*, which are inclined from the burner 1 toward the burner duct 2A, are mixed immediately after flowing into the burner duct 2A. Since the aperture narrowed portion 2*d* is provided in the vicinity of the burner exit 1*a* in the burner duct 2A, mixing between the fuel gas G and the combustion air A1, A2 are further promoted. The eddy current ED is then generated while the mixed gas MG, which flows through the burner duct 2A toward the combustion chamber 3, passes through the aperture enlarged portion 2*c*. As the eddy current ED sucks in high temperature atmosphere inside the adjacent combustion chamber 3 (see an arrow going from the combustion chamber 3 to the aperture enlarged portion 2*c* in FIG. 5), the aperture enlarged portion 2*c* is maintained at high temperature. As a result, the aperture enlarged portion 2*c* serves as a flame-holding portion, where a stabilized ignition point position is formed. Although the illustrated aperture narrowed portion 2*d* is placed at a position slightly distant from the burner exit 1*a*, it may be placed at the position of the burner exit 1*a*.

[Experiment Regarding Combustion Efficiency in Burner Duct and Result Thereof]

The inventors of the present invention conducted an experiment to compare the combustion efficiency in a burner system of conventional structure (Comparative Example) and in the burner system constituting the top-firing hot blast stove of the present invention (Example).

The experiment on the burner system shown in FIG. 4 is outlined as described below. That is, a plurality of types of burner systems were experimentally produced with a length L of the aperture enlarged portion in the burner duct varied in the range from 0D1 (without the aperture enlarged portion) to 2D1, the amount of unburnt CO gas in respective burner systems was measured, and a measured amount without the aperture enlarged portion was normalized to 1 to specify the respective measured amounts in proportion to the normalized value. The result thereof is shown in FIG. 6.

Figure 6:
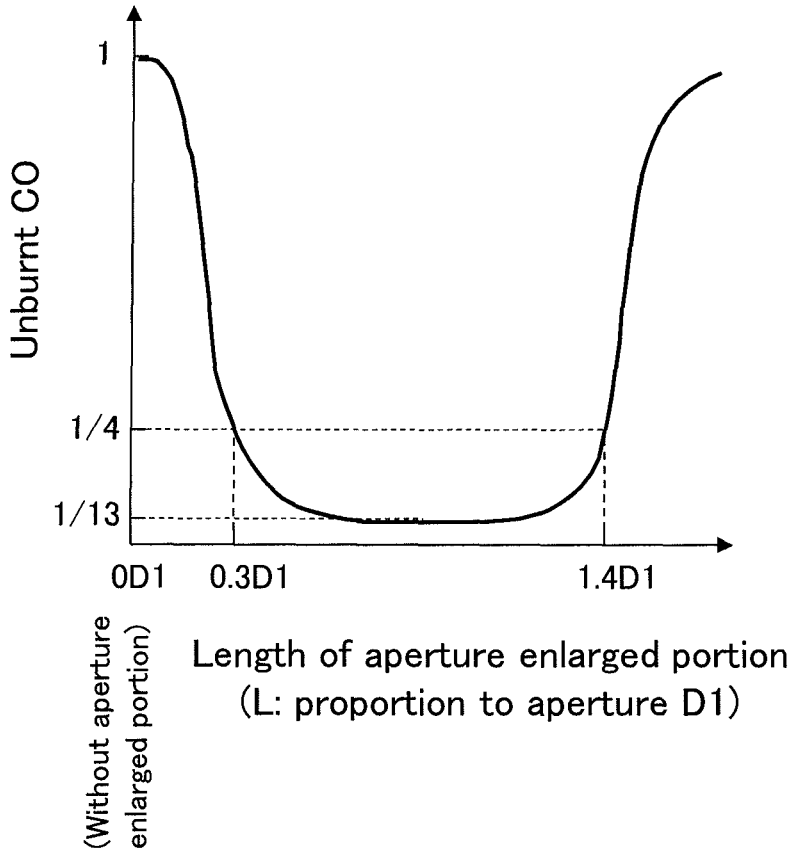
FIG. 6 is a graph showing an experimental result regarding the relationship between a length of the aperture enlarged portion of the burner duct and the amount of unburnt CO.
Figure 7:
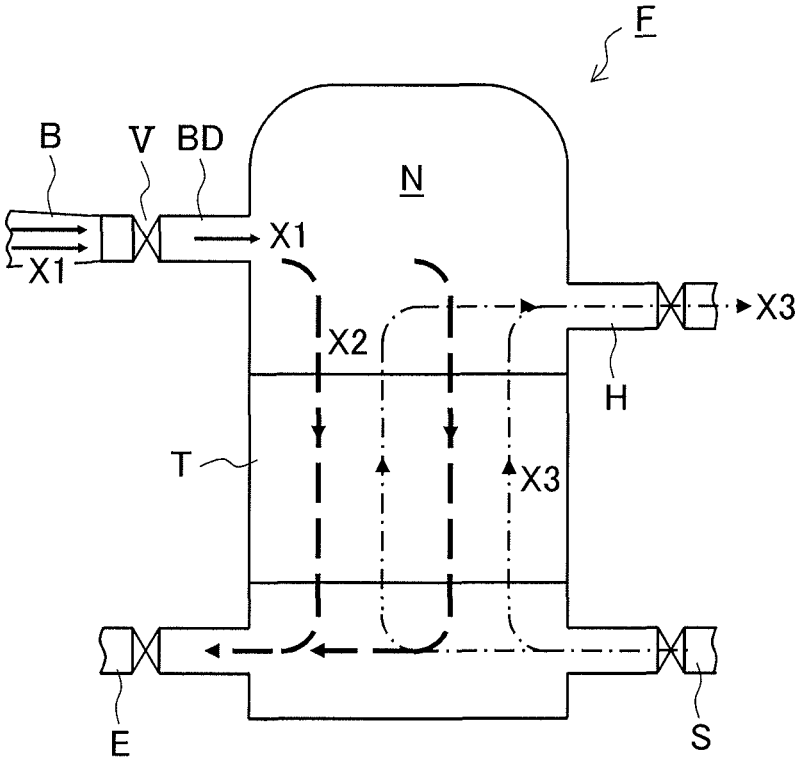
Fig. 7 (Prior Art)
FIG. 7 is a schematic view showing one embodiment of a conventional top-firing hot blast stove, in which flows of mixed gas, combustion gas, hot blast air, and hot blast are shown together.
Figure 8:
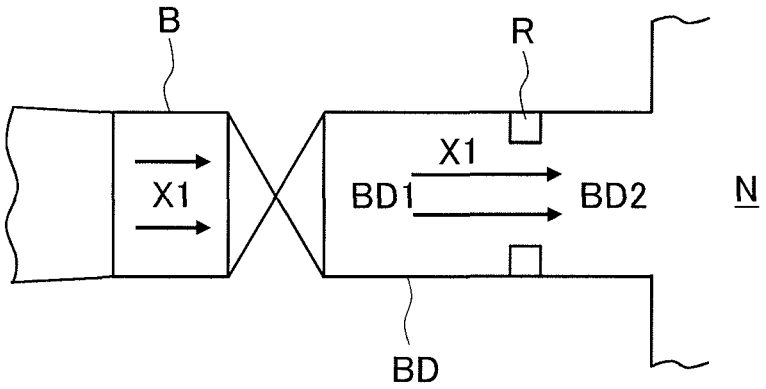
Fig. 8 (Prior Art)
FIG. 8 is a schematic view showing conventional burner duct structure.

As is clear from FIG. 6, it was demonstrated that the amount of unburnt CO gas tends to decrease until the length of the aperture enlarged portion is equal to 0.3D1, and reaches an inflection point at this 0.3D1 point where the value becomes ¼ of the value without the aperture enlarged portion. As the length of the aperture enlarged portion becomes longer, the value is reduced to 1/13, and then shifts to increase before reaching an inflection point at 1.4D1 where the value becomes ¼ of the value without the aperture enlarged portion.

It was demonstrated in this experiment that the length of the aperture enlarged portion is desirably in the range of 0.3D1 to 1.4D1 from a viewpoint of fuel consumption performance. The inventors of the present invention also state other reasons why the length of the aperture enlarged portion in this range is desirable. That is, the obtained length range is specified as an optimum range on the ground that with the length of the aperture enlarged portion being too long, flame holding performance in the aperture enlarged portion may be deteriorated, resulting in deterioration in stability of the ignition position, while with the length of the aperture enlarged portion being too short, combustion gas which swirls with a large turning radius inside the combustion chamber may reach the inside of the aperture enlarged portion as a cross wind, which thereby causes extinguishing.

Although each embodiment of the present invention has been described in full detail with reference to drawings, it should be understood that concrete structure is not limited to the embodiments described, and various medications and variations in design which come within the scope and the spirit of the present invention are therefore intended to be embraced therein.

REFERENCE SIGNS LIST

1 . . . burner, 1*b* . . . inner pipe, 1*c* . . . central pipeline, 1*d* . . . outer pipe, 1*a* . . . burner exit, 2, 2A . . . burner duct, 2*a* . . . shutoff valve, 2*b* . . . burner duct outlet, 2*c* . . . aperture enlarged portion, 2*d* . . . aperture narrowed portion, 3 . . . combustion chamber, 4 . . . checker chamber, 5 . . . hot-blast pipe, 6 . . . blast pipe, 7 . . . gas duct pipe, 10 . . . top-firing hot blast stove, G . . . fuel gas, A1, A2 . . . combustion air, MG . . . mixed gas, ED . . . eddy current

The invention claimed is:

1. A top-firing hot blast stove, comprising:

a checker chamber including a blast pipe for receiving supply of hot blast air; and a combustion chamber including a hot-blast pipe and a burner system for supplying hot blast to a blast furnace, the combustion chamber being positioned above the checker chamber, wherein the checker chamber is heated by combustion of mixed gas including fuel gas and combustion air supplied from the burner system to the combustion chamber, and hot blast which is generated while the hot blast air passing through the checker chamber is supplied to the blast furnace through the hot-blast pipe, wherein the burner system includes (i) a burner provided with a fuel gas pipe, a first combustion air pipe, and a second combustion air pipe, wherein the fuel gas pipe and the second combustion air pipe are concentrically positioned around the first combustion air pipe, and the fuel gas pipe, the first combustion air pipe and the second combustion air pipe extend up to and form a burner exit of the burner, and a wall of an outermost pipe of the concentrically positioned pipes transitions to the burner exit and a burner duct, and (ii) the burner duct communicating with the burner exit of the burner, the burner duct communicating with the combustion chamber through a burner duct outlet disposed at an opposing end of the burner duct relative to the burner exit, wherein the burner duct defines an inner diameter D1 up to a middle of the burner duct and includes an aperture enlarged portion, the inner diameter D1 of the burner duct being enlarged at the aperture enlarged portion to define inner diameter D2 provided over a section from the middle of the burner duct to the burner duct outlet, and wherein the burner duct includes an aperture narrowed portion mounted to and extending from an inner surface of the burner duct immediately adjacent to the burner exit formed by the fuel gas pipe, the first combustion air pipe and the second combustion air pipe, the aperture narrowed portion defining an inner diameter D3 dimensioned smaller than the inner diameter D1 of the burner duct.

2. The top-firing hot blast stove according to claim 1, wherein a length of the aperture enlarged portion to the burner duct outlet is in a range of 0.3D1 to 1.4D1 where D1 represents the inner diameter of the burner duct up to the middle.

3. The top-firing hot blast stove according to claim 1, wherein an eddy current sucks in high temperature atmosphere from the combustion chamber and forms a flame-holding, portion to stabilize an ignition point.

4. The top-firing hot blast stove according to claim 1, wherein the second combustion air pipe is concentrically positioned around the fuel gas pipe.

5. The top-firing hot blast stove according to claim 1, wherein the fuel gas pipe, the first combustion air pipe and the second combustion air pipe are inclined up to the burner exit, thereby defining a narrowed portion where the inner diameter of the burner duct is reduced.

6. The top-firing hot blast stove according to claim 5, wherein the mixed gas including the fuel gas and the combustion air is formed in the narrowed portion.

7. The top-firing hot blast stove according to claim 5, wherein the inclined fuel gas pipe, the first combustion air pipe and the second combustion air pipe define a reduction in respective diameters of the fuel gas pipe, the first combustion air pipe and the second combustion air pipe in the direction of the burner exit.

8. The top-firing hot blast stove according to claim 5, wherein the inclined fuel gas pipe, the first combustion air pipe and the second combustion air pipe promote mixing between the fuel gas and the combustion air.

9. The top-firing hot blast stove according to claim 1, comprising a swirling blade in at least one of the fuel gas pipe, the first combustion air pipe and the second combustion air pipe to generate a spiral flow of at least one of the fuel gas and the combustion air.

10. The top-firing hot blast stove according to claim 1, wherein the burner system comprises a second burner and a second burner duct, the second burner duct communicating with the combustion chamber through a second burner duct outlet.

11. The top-firing hot blast stove according to claim 10, wherein the burner duct and the second burner duct are connected to the combustion chamber at an eccentric position.

12. The top-firing hot blast stove according to claim 11, wherein the eccentric position is defined by an inflow direction of combustion gas from the burner duet and the second burner duct into the combustion chamber which does not pass through a center of the combustion chamber.

13. The top-firing hot blast stove according to claim 12, wherein combustion gas from the burner duct flowing into the combustion chamber interferes with combustion gas flowing into the combustion chamber from the second burner duct.

14. The top-firing hot blast stove according to claim 13, wherein interference between the combustion gas flowing into the combustion chamber from the burner duct and the combustion gas flowing into the combustion chamber from the second burner duct forms a swirling flow of combustion gas in the combustion chamber.

15. The top-firing, hot blast stove according to claim 14, wherein the swirling flow of combustion gas in the combustion chamber supplies the combustion gas to the checker chamber in a uniform manner.

16. The top-firing hot blast stove according to claim 1, wherein a transition connects the inner diameter D1 of the burner duct and the inner diameter D2 of the aperture enlarged portion, and wherein the transition of the burner duct located between the inner diameter D1 and the aperture enlarged portion comprises a beveled burner duct portion.

17. The top-firing hot blast stove according to claim 16, wherein the beveled burner duct portion facilitates generation of an eddy current of the mixed gas.

18. The top-firing hot blast stove according to claim 1, wherein the aperture narrowed portion promotes mixing between the fuel gas and the combustion air flowing from the fuel gas pipe, the first combustion air pipe and the second combustion air pipe.

19. The top-firing hot blast stove according to claim 18, wherein the aperture narrowed portion includes beveled edges leading to the inner diameter D3 dimensioned smaller than the inner diameter D1 of the burner duct.

* * * * *